US008077132B2

(12) United States Patent
Kinoshita

(10) Patent No.: US 8,077,132 B2
(45) Date of Patent: Dec. 13, 2011

(54) FLAT DISPLAY DEVICE AND METHOD OF DRIVING THE SAME

(75) Inventor: Kouhei Kinoshita, Fukaya (JP)

(73) Assignee: Toshiba Matsushita Display Technology Co., Ltd., Tokyo (JP)

( * ) Notice: Subject to any disclaimer, the term of this patent is extended or adjusted under 35 U.S.C. 154(b) by 881 days.

(21) Appl. No.: 11/816,211

(22) PCT Filed: Jan. 10, 2007

(86) PCT No.: PCT/JP2007/050118

§ 371 (c)(1),
(2), (4) Date: Sep. 4, 2007

(87) PCT Pub. No.: WO2007/080864

PCT Pub. Date: Jul. 19, 2007

(65) Prior Publication Data

US 2008/0100599 A1 May 1, 2008

(30) Foreign Application Priority Data

Jan. 11, 2006 (JP) ..... 2006-004167

(51) Int. Cl.
*G09G 3/36* (2006.01)

(52) U.S. Cl. ..... 345/100; 345/89; 345/94; 345/204; 345/208; 345/98

(58) Field of Classification Search ..... 345/100, 345/87, 79, 96, 98, 99, 209, 204
See application file for complete search history.

(56) References Cited

U.S. PATENT DOCUMENTS

| | | | | |
|---|---|---|---|---|
| 6,977,635 | B2 * | 12/2005 | Ogawa et al. | 345/93 |
| 7,683,873 | B2 * | 3/2010 | Okamura et al. | 345/98 |
| 2005/0035934 | A1 * | 2/2005 | Kitani et al. | 345/87 |

FOREIGN PATENT DOCUMENTS

| | | |
|---|---|---|
| JP | 3 220591 | 9/1991 |
| JP | 8 292419 | 11/1996 |
| JP | 10 214064 | 8/1998 |
| JP | 2001 312255 | 11/2001 |
| JP | 2003 208132 | 7/2003 |
| JP | 2005 92176 | 4/2005 |
| KR | 10-2005-0017401 | 2/2005 |

OTHER PUBLICATIONS

Office Action issued Mar. 29, 2011, in Japan Patent application No. 2006-004167 (with English translation).

* cited by examiner

*Primary Examiner* — Lun-Yi Lao
*Assistant Examiner* — Olga Merkoulova
(74) *Attorney, Agent, or Firm* — Oblon, Spivak, McClelland, Maier & Neustadt, L.L.P.

(57) ABSTRACT

An object of the present invention is to provide a flat display device which achieves an excellent and stable display even when the periodicity of voltage polarity is switched at the beginning of a frame at the time of driving a signal line while providing a periodicity of every M scanning lines to the voltage polarity of signal lines in each frame. A control circuit 22 controls so as to provide a voltage polarity of the final line in the periodicity of every four scanning lines to a signal line prior to driving a signal line corresponding to the first scanning line Y(1) at the beginning of a frame.

4 Claims, 17 Drawing Sheets

| | X1 | X2 | X3 | X4 | X5 | X6 | X7 | X8 |
|---|---|---|---|---|---|---|---|---|
| | R | G | B | R | G | B | R | G |
| PRELIMINARY DRIVE | -4 | +2 | +3 | -1 | -3 | +1 | +4 | -2 |
| Y(1) | +2 | +3 | -1 | -4 | +1 | +4 | -2 | -3 |
| Y(2) | +3 | -1 | -4 | +2 | +4 | -2 | -3 | +1 |
| Y(3) | -1 | -4 | +2 | +3 | -2 | -3 | +1 | +4 |
| Y(4) | -4 | +2 | +3 | -1 | -3 | +1 | +4 | -2 |

n-th FRAME

| | X1 | X2 | X3 | X4 | X5 | X6 | X7 | X8 |
|---|---|---|---|---|---|---|---|---|
| | R | G | B | R | G | B | R | G |
| Y(n-1) | -4 | +2 | +3 | -1 | -3 | +1 | +4 | -2 |
| Y(n) | +2 | +3 | -1 | -4 | +1 | +4 | -2 | -3 |
| Y(n+1) | +3 | -1 | -4 | +2 | +4 | -2 | -3 | +1 |
| Y(n+2) | -1 | -4 | +2 | +3 | -2 | -3 | +1 | +4 |
| Y(n+3) | -4 | +2 | +3 | -1 | -3 | +1 | +4 | -2 |

(n+1)th FRAME

| | X1 | X2 | X3 | X4 | X5 | X6 | X7 | X8 |
|---|---|---|---|---|---|---|---|---|
| | R | G | B | R | G | B | R | G |
| Y(n-1) | +3 | -1 | -4 | +2 | +4 | -2 | -3 | +1 |
| Y(n) | -1 | -4 | +2 | +3 | -2 | -3 | +1 | +4 |
| Y(n+1) | -4 | +2 | +3 | -1 | -3 | +1 | +4 | -2 |
| Y(n+2) | +2 | +3 | -1 | -4 | +1 | +4 | -2 | -3 |
| Y(n+3) | +3 | -1 | -4 | +2 | +4 | -2 | -3 | +1 |

FIG. 10 n-th FRAME

| | | | | | | | | |
|---|---|---|---|---|---|---|---|---|
| Y(n) | -2 | 0 | -2 | 0 | -2 | 0 | -2 | 0 |
| Y(n+1) | 0 | -2 | 0 | -2 | 0 | -2 | 0 | -2 |
| Y(n+2) | -2 | 0 | -2 | 0 | -2 | 0 | -2 | 0 |
| Y(n+3) | 0 | -2 | 0 | -2 | 0 | -2 | 0 | -2 |

(n+1)th FRAME

| | | | | | | | | |
|---|---|---|---|---|---|---|---|---|
| Y(n) | -2 | 0 | -2 | 0 | -2 | 0 | -2 | 0 |
| Y(n+1) | 0 | -2 | 0 | -2 | 0 | -2 | 0 | -2 |
| Y(n+2) | -2 | 0 | -2 | 0 | -2 | 0 | -2 | 0 |
| Y(n+3) | 0 | -2 | 0 | -2 | 0 | -2 | 0 | -2 |

FIG. 11 n-th FRAME

| | | | | | | | | |
|---|---|---|---|---|---|---|---|---|
| Y(n) | -1 | 0 | 0 | -1 | 0 | -1 | -1 | 0 |
| Y(n+1) | 0 | 0 | -1 | -1 | -1 | -1 | 0 | 0 |
| Y(n+2) | 0 | -1 | -1 | 0 | -1 | 0 | 0 | -1 |
| Y(n+3) | -1 | -1 | 0 | 0 | 0 | 0 | -1 | -1 |

(n+1)th FRAME

| | | | | | | | | |
|---|---|---|---|---|---|---|---|---|
| Y(n) | 0 | -1 | -1 | 0 | -1 | 0 | 0 | -1 |
| Y(n+1) | -1 | -1 | 0 | 0 | 0 | 0 | -1 | -1 |
| Y(n+2) | -1 | 0 | 0 | -1 | 0 | -1 | -1 | 0 |
| Y(n+3) | 0 | 0 | -1 | -1 | -1 | -1 | 0 | 0 |

FIG. 12 n-th FRAME

| | | | | | | | | |
|---|---|---|---|---|---|---|---|---|
| Y(n) | -3 | 0 | -2 | -1 | -2 | -1 | -3 | 0 |
| Y(n+1) | 0 | -2 | -1 | -3 | -1 | -3 | 0 | -2 |
| Y(n+2) | -2 | -1 | -3 | 0 | -3 | 0 | -2 | -1 |
| Y(n+3) | -1 | -3 | 0 | -2 | -2 | -2 | -1 | -3 |

(n+1)th FRAME

| | | | | | | | | |
|---|---|---|---|---|---|---|---|---|
| Y(n) | -2 | -1 | -3 | 0 | -3 | 0 | -2 | -1 |
| Y(n+1) | -1 | -3 | 0 | -2 | 0 | -2 | -1 | -3 |
| Y(n+2) | -3 | 0 | -2 | -1 | -2 | -1 | -3 | 0 |
| Y(n+3) | 0 | -2 | -1 | -3 | -1 | -3 | 0 | -2 |

FIG. 13

| | R | G | B | R | G | B | | |
|---|---|---|---|---|---|---|---|---|
| Y(n) | -2.5 | -0.5 | -2.5 | -0.5 | -2.5 | -0.5 | -2.5 | -0.5 |
| Y(n+1) | -0.5 | -2.5 | -0.5 | -2.5 | -0.5 | -2.5 | -0.5 | -2.5 |
| Y(n+2) | -2.5 | -0.5 | -2.5 | -0.5 | -2.5 | -0.5 | -2.5 | -0.5 |
| Y(n+3) | -0.5 | -2.5 | -0.5 | -2.5 | -0.5 | -2.5 | -0.5 | -2.5 |

FIG. 16

(n-1)th FRAME n-th FRAME

| | X1 | X2 | X3 | X4 |
|---|---|---|---|---|
| Y(v) | +2 | +3 | -1 | -4 |
| Y(1) | +2 | +3 | -1 | -4 |
| Y(2) | +3 | -1 | -4 | +2 |
| Y(3) | -1 | -4 | +2 | +3 |
| Y(4) | -4 | +2 | +3 | -1 |

(a)

| | X1 | X2 | X3 | X4 |
|---|---|---|---|---|
| Y(v) | +3 | -1 | -4 | +2 |
| Y(1) | +2 | +3 | -1 | -4 |
| Y(2) | +3 | -1 | -4 | +2 |
| Y(3) | -1 | -4 | +2 | +3 |
| Y(4) | -4 | +2 | +3 | -1 |

(b)

| | X1 | X2 | X3 | X4 |
|---|---|---|---|---|
| Y(v) | -1 | -4 | +2 | +3 |
| Y(1) | +2 | +3 | -1 | -4 |
| Y(2) | +3 | -1 | -4 | +2 |
| Y(3) | -1 | -4 | +2 | +3 |
| Y(4) | -4 | +2 | +3 | -1 |

(c)

| | X1 | X2 | X3 | X4 |
|---|---|---|---|---|
| Y(v) | -4 | +2 | +3 | -1 |
| Y(1) | +2 | +3 | -1 | -4 |
| Y(2) | +3 | -1 | -4 | +2 |
| Y(3) | -1 | -4 | +2 | +3 |
| Y(4) | -4 | +2 | +3 | -1 |

(d)

n-th FRAME

| | R | G | B | R | G | B | R | G |
|---|---|---|---|---|---|---|---|---|
| Y(v) | -1 | -4 | +2 | +3 | -2 | -3 | +1 | +4 |
| Y(1) | +2 | +3 | -1 | -4 | +1 | +4 | -2 | -3 |
| Y(2) | +3 | -1 | -4 | +2 | +4 | -2 | -3 | +1 |
| Y(3) | -1 | -4 | +2 | +3 | -2 | -3 | +1 | +4 |
| Y(4) | -4 | +2 | +3 | -1 | -3 | +1 | +4 | -2 |

(n+1)th FRAME

| | R | G | B | R | G | B | R | G |
|---|---|---|---|---|---|---|---|---|
| Y(v) | +2 | +3 | -1 | -4 | +1 | +4 | -2 | -3 |
| Y(1) | -1 | -4 | +2 | +3 | -2 | -3 | +1 | +4 |
| Y(2) | -4 | +2 | +3 | -1 | -3 | +1 | +4 | -2 |
| Y(3) | +2 | +3 | -1 | -4 | +1 | +4 | -2 | -3 |
| Y(4) | +3 | -1 | -4 | +2 | +4 | -2 | -3 | +1 |

FIG. 18 n-th FRAME

| | | | | | | | | |
|---|---|---|---|---|---|---|---|---|
| Y(1) | -2 | -2 | -2 | -2 | -2 | -2 | -2 | -2 |
| Y(2) | 0 | -2 | 0 | -2 | 0 | -2 | 0 | -2 |
| Y(3) | -2 | 0 | -2 | 0 | -2 | 0 | -2 | 0 |
| Y(4) | 0 | -2 | 0 | -2 | 0 | -2 | 0 | -2 |

(n+1)th FRAME

| | | | | | | | | |
|---|---|---|---|---|---|---|---|---|
| Y(1) | -2 | -2 | -2 | -2 | -2 | -2 | -2 | -2 |
| Y(2) | 0 | -2 | 0 | -2 | 0 | -2 | 0 | -2 |
| Y(3) | -2 | 0 | -2 | 0 | -2 | 0 | -2 | 0 |
| Y(4) | 0 | -2 | 0 | -2 | 0 | -2 | 0 | -2 |

FIG. 19 n-th FRAME

| | | | | | | | | |
|---|---|---|---|---|---|---|---|---|
| Y(1) | -1 | 0 | 0 | -1 | 0 | -1 | -1 | 0 |
| Y(2) | 0 | 0 | -1 | -1 | -1 | -1 | 0 | 0 |
| Y(3) | 0 | -1 | -1 | 0 | -1 | 0 | 0 | -1 |
| Y(4) | -1 | -1 | 0 | 0 | 0 | 0 | -1 | -1 |

(n+1)th FRAME

| | | | | | | | | |
|---|---|---|---|---|---|---|---|---|
| Y(1) | 0 | -1 | -1 | 0 | -1 | 0 | 0 | -1 |
| Y(2) | -1 | -1 | 0 | 0 | 0 | 0 | -1 | -1 |
| Y(3) | -1 | 0 | 0 | -1 | 0 | -1 | -1 | 0 |
| Y(4) | 0 | 0 | -1 | -1 | -1 | -1 | 0 | 0 |

FIG. 20 n-th FRAME

| | | | | | | | | |
|---|---|---|---|---|---|---|---|---|
| Y(1) | -3 | -2 | -2 | -3 | -2 | -3 | -3 | -2 |
| Y(2) | 0 | -2 | -1 | -3 | -1 | -3 | 0 | -2 |
| Y(3) | -2 | -1 | -3 | 0 | -3 | 0 | -2 | -1 |
| Y(4) | -1 | -3 | 0 | -2 | 0 | -2 | -1 | -3 |

(n+1)th FRAME

| | | | | | | | | |
|---|---|---|---|---|---|---|---|---|
| Y(1) | -2 | -3 | -3 | -2 | -3 | -2 | -2 | -3 |
| Y(2) | -1 | -3 | 0 | -2 | 0 | -2 | -1 | -3 |
| Y(3) | -3 | 0 | -2 | -1 | -2 | -1 | -3 | 0 |
| Y(4) | 0 | -2 | -1 | -3 | -1 | -3 | 0 | -2 |

FIG. 21

| | | | | | | | | |
|---|---|---|---|---|---|---|---|---|
| Y(1) | -2.5 | -2.5 | -2.5 | -2.5 | -2.5 | -2.5 | -2.5 | -2.5 |
| Y(2) | -0.5 | -2.5 | -0.5 | -2.5 | -0.5 | -2.5 | -0.5 | -2.5 |
| Y(3) | -2.5 | -0.5 | -2.5 | -0.5 | -2.5 | -0.5 | -2.5 | -0.5 |
| Y(4) | -0.5 | -2.5 | -0.5 | -2.5 | -0.5 | -2.5 | -0.5 | -2.5 |

FLAT DISPLAY DEVICE AND METHOD OF DRIVING THE SAME

TECHNICAL FIELD

The present invention relates to a flat display device and method of driving the flat display device, and more particularly relates to the flat display device that inverts the polarity of a signal line and writes a video signal from the signal line to a pixel and a method of driving the flat display device.

BACKGROUND ART

Conventionally, in word processors, personal computers, portable TVs, and the like, thin and lightweight flat display devices are widely used. Among them, in an active-matrix type liquid crystal display device, a thin film transistor (TFT) is disposed at each intersection between a plurality of signal lines and a plurality of scanning lines. This liquid crystal display device has the advantage of being excellent in chromogenic characteristics and having fewer afterimages.

Progress in the manufacturing process technology in recent years allows driver circuits to be integrally formed on an array substrate, thus the number of connection parts and of connecting wires with the outside are reduced. As a result, cost reduction can be achieved. Then, there is known a technique described in Japanese Patent Application Laid-Open Publication No. 2001-312255, for example. This technique allows to correspond a video signal line from a driver IC with signal lines on an array substrate by 1:N (N is an integer equal to or greater than 2) in a liquid crystal display device, thereby enabling a multi-selection drive in which one signal line is sequentially selected out of a group of N signal lines in one horizontal scanning period by an analog switch circuit and then the selected one is connected to a video signal line.

Generally, methods of writing a video signal from a signal line to a pixel include a vertical line inversion driving method and an H/V inversion driving method (also called a dot inversion drive). In the vertical line inversion driving method, the polarity of a signal line is inverted between adjacent signal lines to provide a video signal. In the H/V inversion driving method, the polarity of a signal line is switched for each horizontal scanning period to provide a video signal, and at the same time, the polarity of a signal line between adjacent signal lines is inverted to provide a video signal.

For example, in a 2H2V inversion driving method of selecting four signal lines, in which the value of N in the multi-selection drive of signal lines is set to 4 and the polarity of a signal line is switched every two horizontal scanning periods to provide a video signal, and also the polarity of the adjacent signal lines is inverted every two signal lines to provide a video signal, a signal line is driven while providing a periodicity of every M scanning lines (M is an even number) to the voltage polarity of the signal line.

Recently, there is known a technique described in Japanese Patent Application Laid-Open Publication No. 2005-92176, for example. Taking into consideration the presence of polarity inversion of each signal line between adjacent scanning lines in a liquid crystal display device and the presence of polarity inversion between adjacent signal lines when selecting one signal line out of a group of N signal lines, this technique controls the selection order of signal lines to be selected earlier and the selection order of signal lines selected later in each group. This makes less visible the unevenness caused by write deficiency due to polarity inversion of a signal line.

Switching of the voltage polarity of signal lines with such periodicity is carried out for each frame. Specifically, this is carried out at the timing when a data enable signal indicating that a video data signal is to be provided from an external device has been identified for the first time at the beginning of a frame.

DISCLOSURE OF THE INVENTION

However, in the liquid crystal display device with the conventional technique, even after providing one frame of video data signals and entering the vertical blanking period of the next frame, the periodicity is continuously provided to the voltage polarity of signal lines. For this reason, if the voltage polarity of signal lines is switched at the beginning of a frame, the periodicity of voltage polarity of signal lines may be disrupted. This results in a display failure at the first scanning line in a display screen. Especially when a half tone is displayed in the entire screen, the liquid crystal display device with the conventional technique has a problem that a difference in brightness between the first line and the second or subsequent line is prominent and thus an excellent display cannot be obtained.

The present invention has been made in view of the above problems. An object of the present invention is to provide a flat display device and a method of driving the flat display device which achieve an excellent and stable display even when the cycle of voltage polarity is switched at the beginning of a frame at the time of driving a signal line while providing a periodicity of every M scanning lines to the voltage polarity of the signal line in each frame.

A flat display device according to the present invention includes: a pixel display part in which a pixel is disposed at each intersection between multiple rows of scanning lines and multiple columns of signal lines; a driver circuit which provides a video signal through a video signal line; an analog switch circuit that connects a signal line selected from N signal lines (N is an integer equal to or greater than 2) to the video signal line for each of groups in which each of the video signal lines from the driver circuit corresponds to N signal lines; and a control circuit which controls to drive a signal line while providing a periodicity of every M scanning lines (M is an even number) to the voltage polarity of the signal line in each frame and at the same time provides a voltage polarity in the final line out of the M lines to a signal line prior to driving the signal line corresponding to the first scanning line at the beginning of a frame.

According to an aspect of a method of driving a flat display device concerning the present invention, in a method of driving a flat display device of a multi-selection drive method, the flat display device including a pixel display part in which a pixel is disposed at each intersection between multiple rows of scanning lines and multiple columns of signal lines, the flat display device being adapted to provide a video signal to a plurality of video signal lines and to selectively switch and connect the signal line by an analog switch, N signal lines (N is an integer equal to or greater than 2) corresponding to each of the video signal lines, a periodicity of every M scanning lines (M is an even number) is provided to the voltage polarity of signal lines for driving, and at the same time prior to driving the signal line corresponding to the first scanning line of each frame, the signal line is preliminarily driven.

In the present invention, a control circuit controls so as to provide a voltage polarity of the final line out of the M lines prior to driving the signal line corresponding to the first scanning line at the beginning of a frame. Since in the first scanning line a voltage polarity at the leading line of the M lines is provided to the signal line, the periodicity of every M line (M is an integer equal to or greater than 2) is maintained for all the scanning lines in each frame even when the cycle of voltage polarity is switched at the beginning of a frame. This distributes the drive conditions of pixels evenly across the entire display screen, so that the unevenness caused by write deficiency due to the polarity inversion of a signal line can be made less visible.

BRIEF DESCRIPTION OF THE DRAWINGS

FIG. 10 is a view showing a distribution of pixels, in which the polarity inversion of a signal line occurs, in the voltage polarity and selection order of the above-described signal lines.

FIG. 11 is a view showing a distribution of pixels, in which the polarity inversion of the output of a driver IC occurs, in the voltage polarity and selection order of the above-described signal lines.

FIG. 12 is a view showing the above-described polarity inversion of signal lines in combination with the above-described polarity inversion of the output of the driver IC.

FIG. 13 is a view showing a result obtained by averaging the combined results of the above-described polarity inversion of signal lines and polarity inversion of the output of the driver IC with n-th and n+1th frames.

FIG. 16 is a view showing a case where the cycle of voltage polarity of signal lines is assigned from the first scanning line.

FIG. 18 is a view showing a distribution of pixels, in which the polarity inversion of a signal line occurs, in the voltage polarity and selection order of the signal lines shown in FIG. 17.

FIG. 19 is a view showing a distribution of pixels, in which the polarity inversion of the output of the driver IC occurs, in the voltage polarity and selection order of the signal lines shown in FIG. 17.

FIG. 20 is a view showing the polarity inversion of the signal lines of FIG. 18 in combination with the polarity inversion of the output of the driver IC of FIG. 19.

FIG. 21 is a view showing a result obtained by averaging the combined results of the polarity inversion of the signal lines and the polarity inversion of the output of the driver IC shown in FIG. 20 with the n-th and n+1th frames.

BEST MODE FOR CARRYING OUT THE INVENTION

Hereinafter, a liquid crystal display device and a method of driving the liquid crystal display device in an embodiment will be described using the accompanying drawings.

Figure 1:
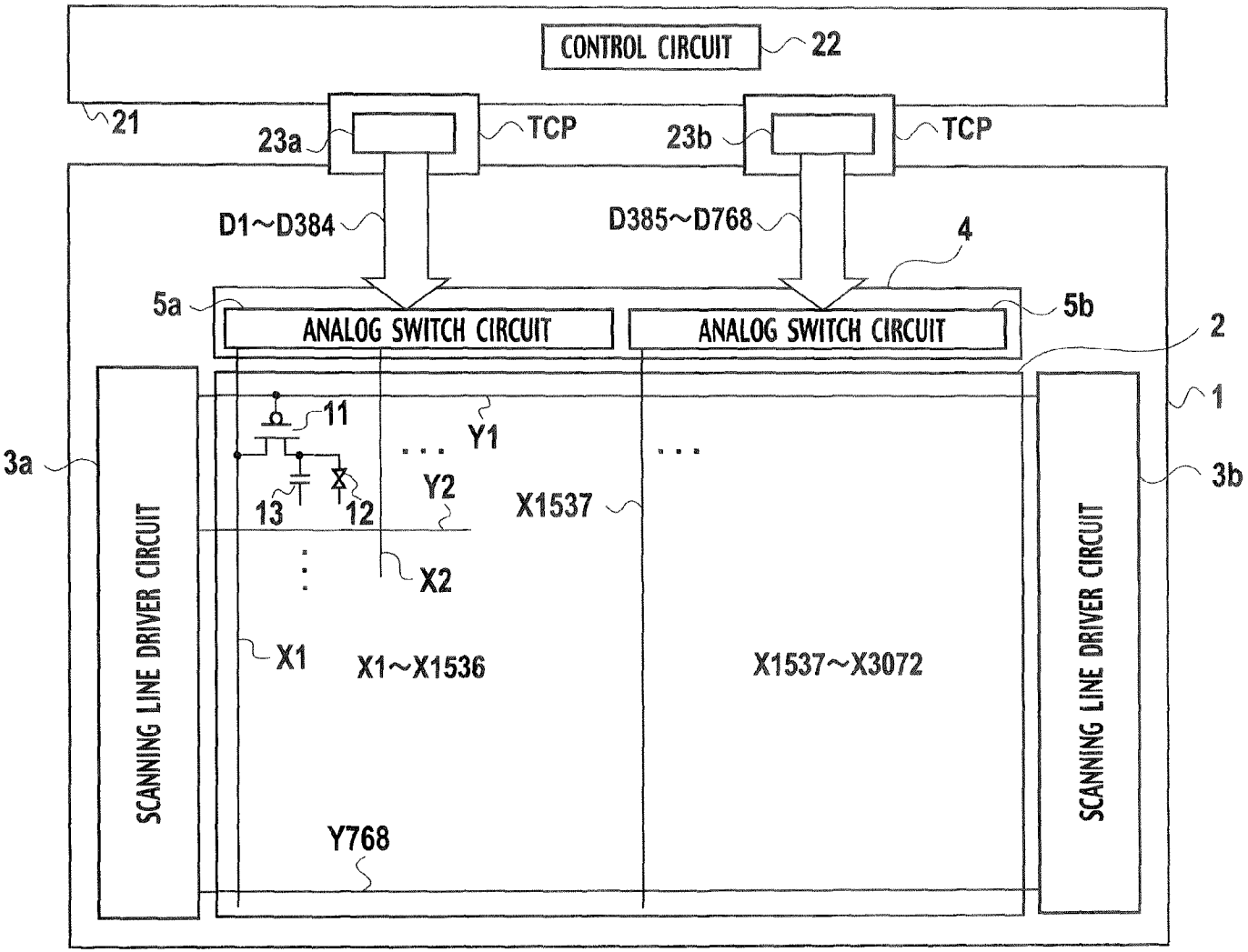
FIG. 1 is a circuit block diagram showing a schematic configuration of a liquid crystal display device according to an embodiment.

As shown in a circuit block diagram of FIG. 1, the liquid crystal display device in the embodiment includes: a pixel display part 2 on an array substrate 1 made of glass; scanning line driver circuits 3*a* and 3*b* (hereinafter, collectively referred to as the scanning line driver circuit 3) disposed at both right and left ends thereof; a signal line driver circuit 4 disposed at the upper end thereof, a control circuit 22 disposed on an external board 21; and driver ICs 23*a* and 23*b* mounted in TCP that connects the both substrates.

In the pixel display part 2, a plurality of scanning lines Y1 to Y768 routed from the scanning line driver circuit 3 and a plurality of signal lines X1 to X3072 routed from the signal line driver circuit 4 are wired so as to intersect with each other. At each intersection, a pixel including a thin-film transistor 11, a liquid crystal capacity 12, and an auxiliary capacity 13 is disposed. The thin-film transistor 11 is a MOS-FET, for example, the drain terminal of which is connected to the liquid crystal capacity 12 and the auxiliary capacity 13, the source terminal of which is connected to a signal line X, and the gate terminal of which is connected to a scanning line Y. Here, as an example, an XGA display panel is taken, in which 768 scanning lines and 1024×3 (RGB)=3072 signal lines are wired and 768×1024×3 (RGB) pixels are disposed.

The scanning line driver circuit 3 drives the respective scanning lines Y1 to Y768 and the signal line driver circuit 4 drives the respective signal lines X1 to X3072. The signal line driver circuit 4 includes analog switch circuit arrays 5*a* and 5*b*. The analog switch circuit array 5*a* drives the signal lines X1 to X1536 and the analog switch circuit array 5*b* drives the signal lines X1537 to X3072.

Based on the video data signal, synchronizing signal, clock signal, and the like transmitted via an interface cable from an external device, the control circuit 22 generates timing signals required for peripheral circuits, such as the scanning line driver circuit 3 and signal line driver circuit 4, and driver ICs 23*a* and 23*b*, and also transfers the video signal to the driver ICs 23*a* and 23*b*.

The driver ICs 23*a* and 23*b* are mounted as a TCP by use of a TCB method. Video signal lines D1 to D384 and D385 to D768 from the driver ICs 23*a* and 23*b* are connected to the signal lines X1 to X1536 and X1537 to X3072 via the analog switch circuit arrays 5*a* and 5*b*.

For each group when N signal lines (N is an integer equal to or greater than 2) correspond to each video signal line, the analog switch circuit arrays 5*a* and 5*b* switch a signal line selected from the N signal lines, and connect this to a video signal line (multi-selection drive of signal lines). In this embodiment, the value of N is set to four. In this case, because four signal lines for each video signal line are switched to be connected, the number of video signal lines is reduced to ¼ of the number of signal lines. As to the analog switch circuit array 5*a*, 384 video signal lines are required for 1536 signal lines. In the whole XGA display panel having 3072 signal lines, only two driver ICs 23, each having 384 output terminals of video signal lines, are required. In this way, the scale of the driver IC can be reduced significantly.

The driver IC 23*a* transmits video signals to the analog switch circuit array 5*a* via the video signal lines D1 to D384, and the driver IC 23*b* transmits video signals to the analog switch circuit array 5*b* via the video signal lines D385 to D768.

Figure 2:
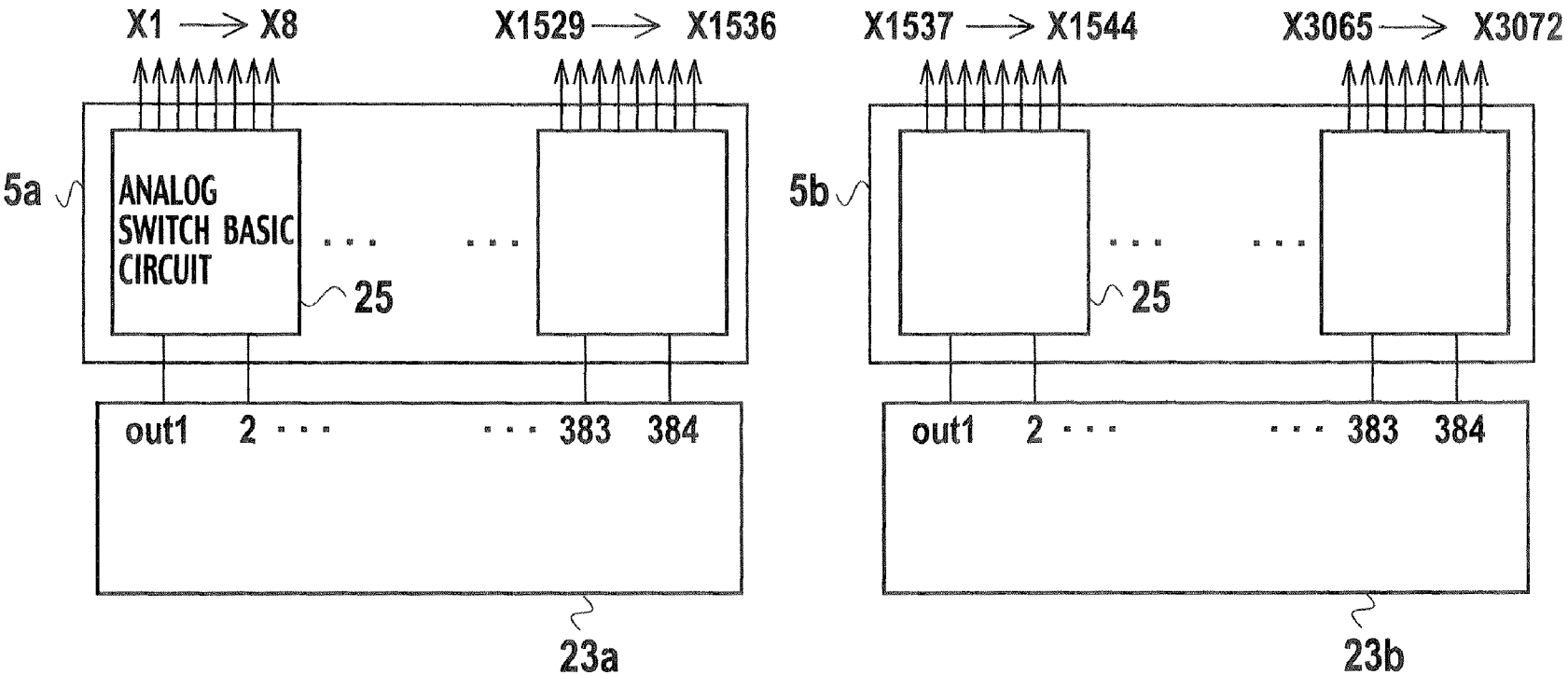
FIG. 2 is a circuit block diagram showing the configuration of a driver IC and an analog switch circuit in the above-described liquid crystal display device.

As shown in a circuit block diagram of FIG. 2, the analog switch circuit arrays 5*a* and 5*b* include analog switch basic circuits 25, respectively, each of which corresponds to two video signal lines. That is, the analog switch circuit arrays 5*a* and 5*b* include 384/2=192 analog switch basic circuits 25, respectively.

Figure 3:
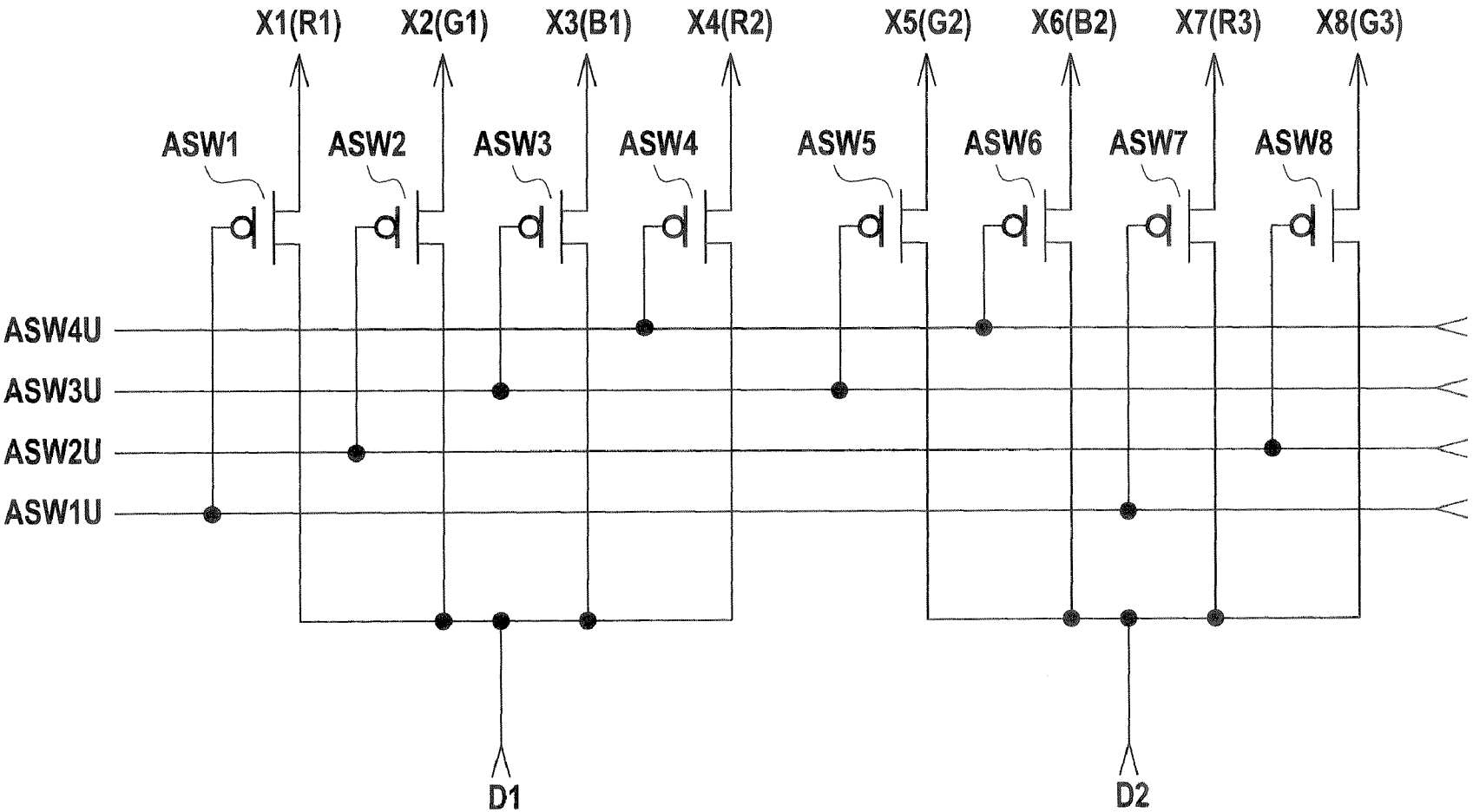
FIG. 3 is a circuit diagram showing the internal configuration of an analog switch basic block in the above-described analog switch circuit.

As shown in a circuit diagram of FIG. 3, for example, in the analog switch basic circuit 25 to which the video signals are inputted via the video signal lines D1 and D2, the video signal line D1 transmitting video signals is branched into 4 lines. The branched video signal line is connected to X1 via an analog switch ASW1, is connected to a signal line x2 via an analog switch ASW2, is connected to a signal line X3 via an analog switch ASW3, and is connected to a signal line X4 via an analog switch ASW4. Here, the signal lines X1 to X4 are referred to as a first group.

Similarly, the video signal line D2 transmitting video signals is also branched into four lines. The branched video signal line is connected to X5 via an analog switch ASW5, is connected to a signal line X6 via an analog switch ASW6, is connected to a signal line X7 via an analog switch ASW7, and is connected to a signal line X8 via an analog switch ASW8. The signal lines X5 to X8 are referred to as a second group.

A control line transmitting an analog switch control signal ASW1U is connected to the respective gate terminals of the analog switches ASW1 and ASW7, a control line of an analog switch control signal ASW2U is connected to the respective gate terminals of the analog switches ASW2 and ASW8, a control line of an analog switch control signal ASW3U is connected to the respective gate terminals of the analog switches ASW3 and ASW5, and a control line of an analog switch control signal ASW4U is connected to the respective gate terminals of the analog switches ASW4 and ASW6.

Each of the analog switches ASW1 to ASW8 is comprised of a p-channel TFT. When the analog switch control signal ASW1U has a low potential, the analog switches ASW1 and ASW7 are turned on and the video signals are supplied to the signal lines X1 and X7. When the analog switch control signal ASW2U has a low potential, the analog switches ASW2 and ASW8 are turned on and the video signals are supplied to the signal lines X2 and X8. When the analog switch control signal ASW3U has a low potential, the analog switches ASW3 and ASW5 are turned on and the video signals are supplied to the signal lines X3 and X5. When the analog switch control signal ASW4U has a low potential, the analog switches ASW4 and ASW6 are turned on and the video signals are supplied to the signal lines X4 and X6. The other analog switch basic circuits have the same configuration as the one described above.

Figure 4:
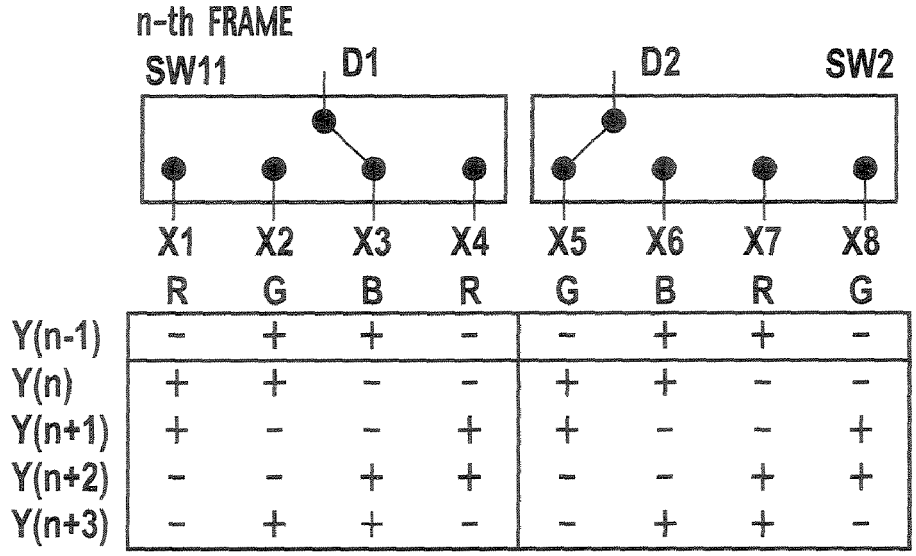
FIG. 4 is a view showing the voltage polarity of signal lines for each pixel in a 2H2V inversion driving method of selecting four signal lines.

Next, a driving method the signal lines in such a multi-selection drive is described using the accompanying drawings. FIG. 4 shows the voltage polarity of signal lines for each pixel in the 2H2V inversion driving method of selecting four signal lines. Plus or minus symbol indicates the voltage polarity of a signal line. The signal lines indicate the first group X1 to X4 and the second group X5 to X8. The polarity of a signal line is switched every two horizontal scanning periods to provide a video signal, and at the same time for the adjacent signal lines the polarity of every two signal lines is inverted to provide a video signal. The signal line is driven while providing a periodicity of every four scanning lines Y(n) to Y(n+3) to the voltage polarity of signal lines. Switching of the voltage polarity of signal lines with such periodicity is carried out for each frame.

Figure 5:
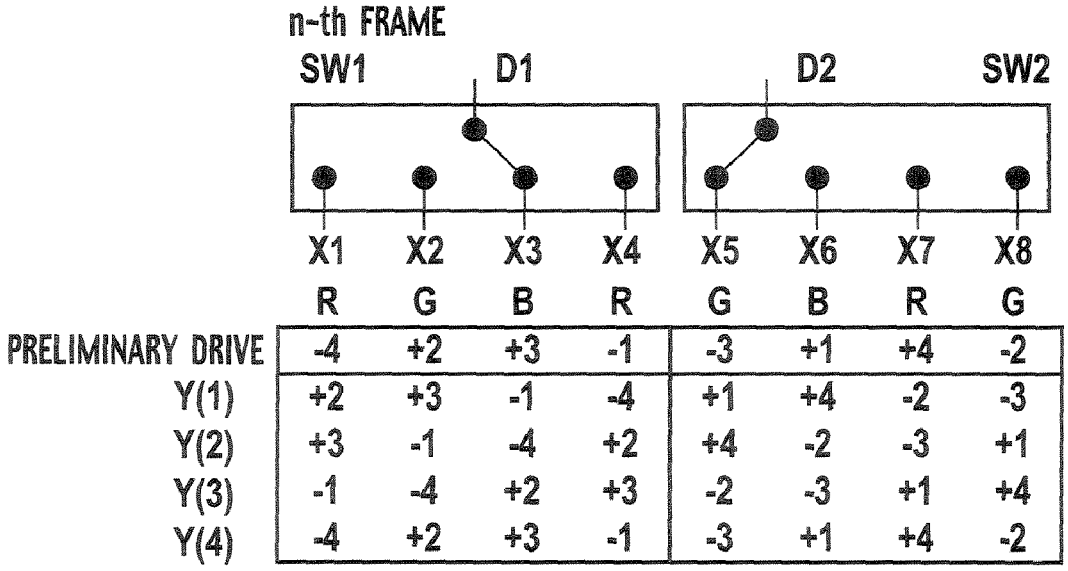
FIG. 5 shows the voltage polarity and selection order of signal lines for each pixel in the above-described 2H2V inversion driving method of selecting four signal lines.

FIG. 5 shows the voltage polarity and selection order of signal lines for each pixel in the 2H2V inversion driving method of selecting four signal lines. The signal lines indicate the first group X1 to X4 and the second group X5 to X8. The number following a plus or minus symbol indicative of the voltage polarity of signal lines indicates the order of signal lines to be selected by the analog switch circuits SW1 and SW2 in one horizontal scanning period. In this embodiment, in order to maintain the periodicity even when the voltage polarity of signal lines is switched at the beginning of a frame, the control circuit 22 performs a preliminary drive so as to provide a voltage polarity of the final line Y(4) out of the four scanning lines Y(1) to Y(4) to a signal line prior to driving the signal line corresponding to the first scanning line Y(1) at the beginning of an n-th frame. Then, the signal line corresponding to the first scanning line Y(1) is driven.

Figure 6:
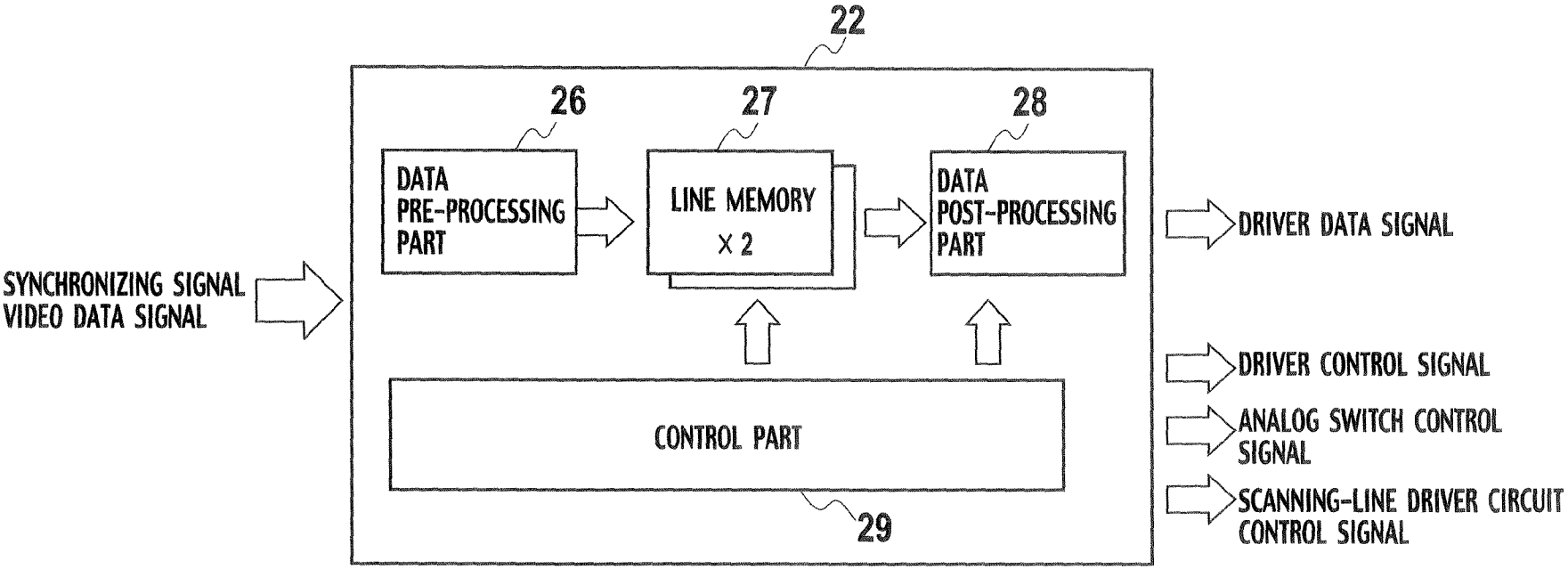
FIG. 6 is a circuit block diagram showing the internal configuration of a control circuit.

As shown in a circuit block diagram of FIG. 6, the control circuit 22 includes a data pre-processing part 26, a line memory 27, a data post-processing part 28, and a control part 29.

The data pre-processing part 26 converts a video data signal being provided in the unit of frame from an external device into a driver data signal having a bit width corresponding to the memory configuration of the line memory 27 and outputs this to the line memory 27. Here, the video data signal is digital data.

The line memory 27 is comprised of two line memories. Each line memory stores one scanning line of driver data signals, for example. The driver data signal outputted from the data pre-processing part 26 is stored in one of the line memories. The driver data signal subsequently outputted is stored in the other line memory. Under the instructions from the control part 29, the driver data signal stored in the line memory is outputted to the data post-processing part 28 at any timing delayed by one horizontal cycle.

Under the instructions from the control part 29, the data post-processing part 28 divides the driver data signal outputted from the line memory 27 for each signal line which the analog switch circuit array 5 selects. The divided driver data signals are transferred to the driver IC 23.

The control part 29 generates the respective control signals for the driver IC, analog switch circuit, and scanning line driver circuit based on the synchronizing signals provided from an external device. Moreover, the control part 29 controls the data post-processing part 28 to divide one scanning line of driver data signals stored in the line memory 27 into four and sequentially transfer these to the driver IC. The control part 29 controls the analog switch circuit to select a signal line at any timing in one horizontal scanning period. The control part 29 controls the driver IC to provide a video signal via the selected signal line.

Next, the operation of the control circuit is described with reference to FIG. 7 and FIG. 8.

Figure 7:
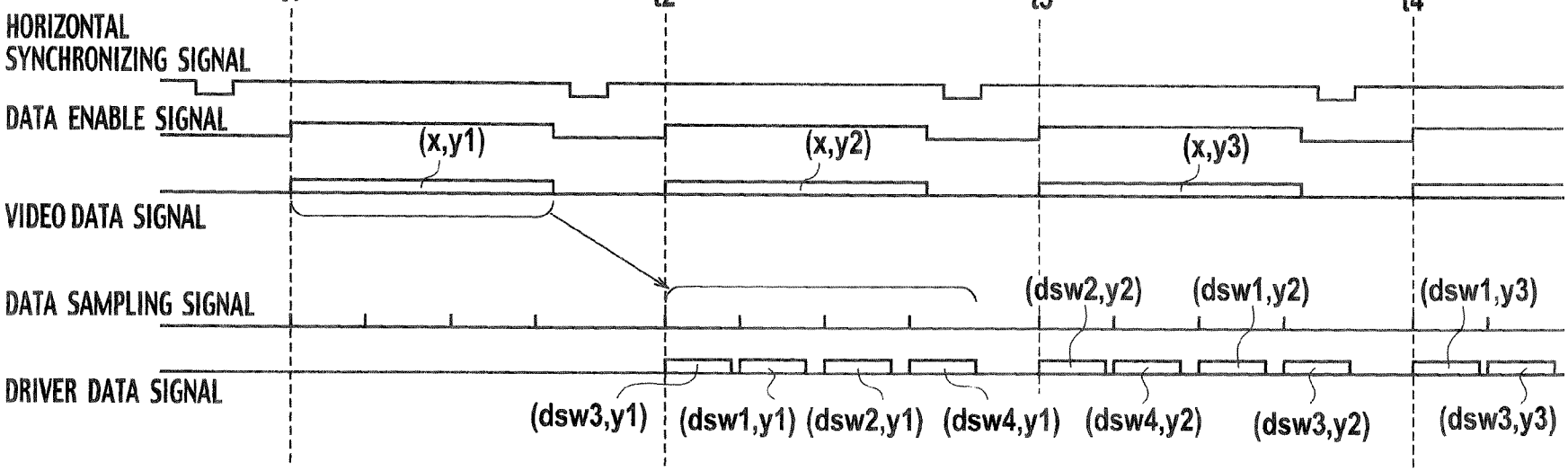
FIG. 7 is a first timing chart explaining the operation of the control circuit.

In a timing chart of FIG. 7, a horizontal synchronizing signal is a synchronizing signal indicative of a start of one scanning and is provided from an external device to the control circuit. Video data signals (x, y1), (x, y2), . . . are provided from an external device to the control circuit at any timing of each scan indicated in the horizontal synchronizing signal. A data enable signal is a synchronizing signal indicating that video data signals are currently provided. The driver data signal consists of the video data signals that are divided into four corresponding to the order of the signal lines X1 to X4, which the analog switch selects, and is provided from the control circuit to the drive IC. A data sampling signal is a synchronizing signal indicating that the driver data is being provided, and is provided from the control circuit to the drive IC.

Figure 8:
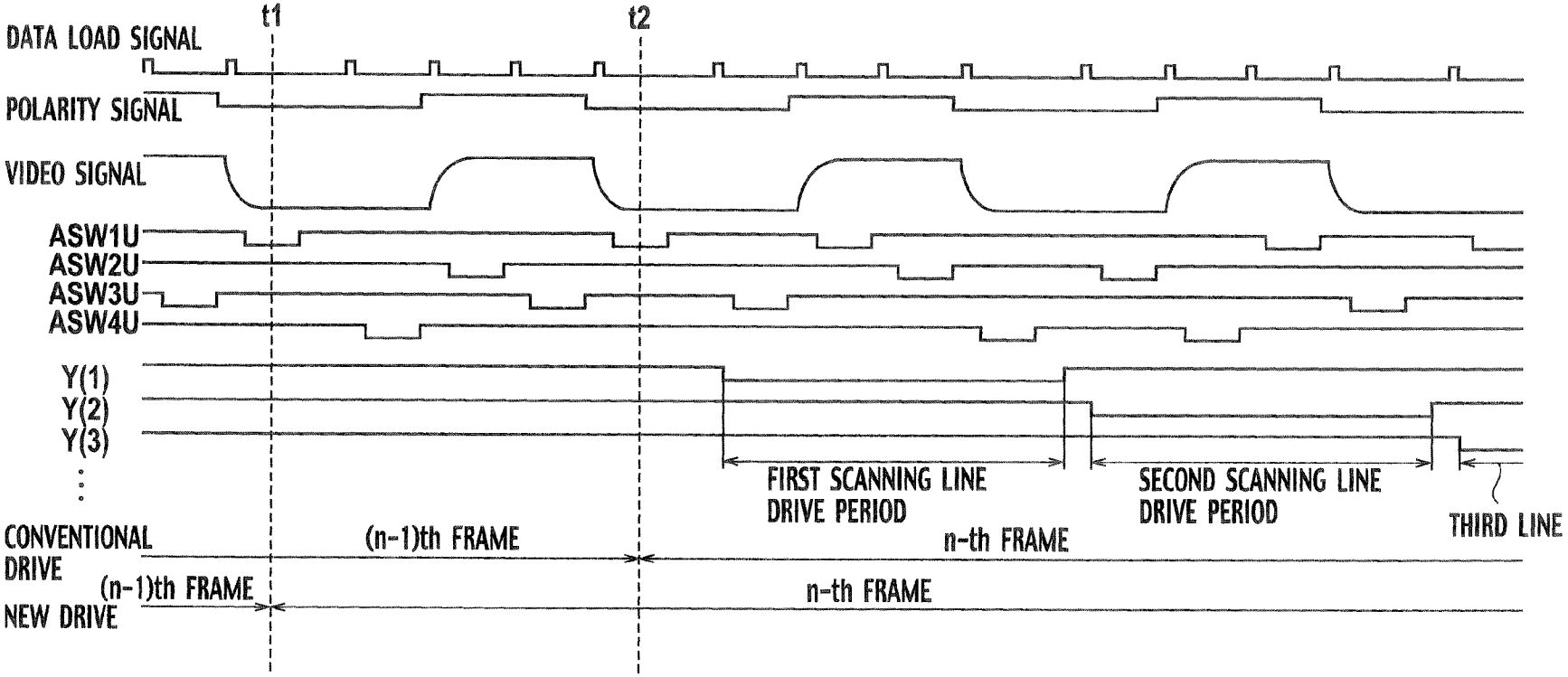
FIG. 8 is a second timing chart explaining the operation of the control circuit.

In a timing chart of FIG. 8, a data load signal is a control signal indicative of timing to drive a video signal line and is provided from the control circuit to the drive IC. A polarity signal is a control signal indicative of the voltage polarity of a signal line to be driven via a video signal line, and is provided from the control circuit to the drive IC. The video signal is an analog signal that is provided from a video signal line of the driver IC to the signal lines X1 to X4 selected by the analog switch. ASW1U to ASW4U are the analog switch control signals for instructing the selection of the signal lines X1 to X4, and is provided from the control circuit to the analog switch. Y(1), Y(2), Y(3), . . . are the control signals provided from the scanning line driver circuit to scanning lines.

First, the driving of an n-th frame is started at time t1. As shown in FIG. 7, the video data signal (x, y1) corresponding to the first scanning line is provided from an external device to the control circuit in synchronization with the starting of the data enable signal.

During the period from time t1 to t2, the video data signal (x, y1) is divided into four. The divided driver data signals (dsw3, y1), (dsw1, y1), (dsw2, y1), and (dsw4, y1) are stored in the line memory. One scanning line of driver data signals will not be transferred to the driver IC 23.

Moreover, during this period, a preliminary drive of a signal line is carried out prior to driving the signal line corresponding to the first scanning line. The control circuit provides a voltage polarity in the final line Y(4) in a cycle of four scanning lines Y(1) to Y(4) as shown in FIG. 5, to the signal line. As shown in FIG. 8, the first group X1 to X4 of signal lines is subjected to a multi-selection drive in a time-sharing in one horizontal scanning period. First, the signal line X4 is selected with the minus polarity by the control signal ASW4U of the analog switch circuit and the polarity signal, then, the signal line X2 is selected with the plus polarity by the control signal ASW2U of the analog switch circuit and the polarity signal, then, the signal line X3 is selected with the plus polarity by the control signal ASW3U of the analog switch circuit and the polarity signal, and, at the last, the signal line X1 is selected with the minus polarity by the control signal ASW1U of the analog switch circuit and the polarity signal. Here, because the signal line is driven as a preliminary drive, the control signal will not be provided to the scanning line. Moreover, although not illustrated, the second group X5 to X8 of signal lines is also subjected to the multi-selection drive in a time-sharing in a similar fashion.

Next, as shown in FIG. 7, during the period from time t2 to t3, a video data signal (x, y2) corresponding to the second scanning line is provided from an external device to the control circuit. At this time, the video data signal (x, y2) is divided into four. The divided driver data signals (dsw2, y2), (dsw4, y2), (dsw1, y2), and (dsw3, y2) are stored in the line memory. At this time, the driver data signals (dsw3, y1), (dsw1, y1), (dsw2, y1), and (dsw4, y1) stored in the line memory are transferred to the driver IC, delayed by one horizontal scanning period.

Moreover, during this period, as shown in FIG. 8, in one horizontal scanning period, a control signal is provided to the scanning line Y(1) and at the same time a voltage polarity in the first line Y(1) in a cycle of four scanning lines Y(1) to Y(4) as shown in FIG. 5 is provided to the signal line. First, the signal line X3 is selected with the minus polarity by the control signal ASW3U of the analog switch circuit and the polarity signal, then the signal line X1 is selected with the plus polarity by the control signal ASW1U of the analog switch circuit and the polarity signal, then the signal line X2 is selected with the plus polarity by the control signal ASW2U of the analog switch circuit and the polarity signal, and, at the last, the signal line X4 is selected with the minus polarity by the control signal ASW4U of the analog switch circuit and the polarity signal. Moreover, although not illustrated, the second group X5 to X8 of signal lines is also subjected to the multi-selection drive in a time-sharing in a similar fashion. Accordingly, to each pixel corresponding to the first scanning line Y(1), a video signal converted into an analog signal is provided from the driver IC via a selected signal line to start displaying images. A similar processing is continuously carried out also for the second and subsequent scanning lines.

In this way, because in the first scanning line Y(1) the voltage polarity in the leading line out of a cycle of four lines as shown in FIG. 5 is provided to the signal line, the periodicity of four lines can be maintained to all the scanning lines in each frame even when the cycle of voltage polarity is switched at the beginning of a frame.

Consequently, according to this embodiment, the control circuit 22 controls so as to provide a voltage polarity in the final line out of four lines to a signal line prior to driving the signal line corresponding to the first scanning line Y(1) at the beginning of a frame. Because in the first scanning line Y(1) the voltage polarity in the leading line of the four lines is provided to the signal line, the periodicity of every four lines is maintained even when the cycle of voltage polarity is switched at the beginning of a frame. Accordingly, an excellent and stable display can be obtained.

Moreover, in this embodiment a cycle of every four scanning line is provided to the voltage polarity of signal lines, but not limited to this as long as an even number equal to or greater than two is employed as the cycle. For example, a cycle of every eight scanning lines may be provided to the voltage polarity of signal lines.

In addition, in this embodiment, the flat display device is assumed to be a liquid crystal display device, but not limited to this as long as the flat display device is of an active-matrix type in which a video signal is written from each signal line to each pixel by inverting the polarity of a signal line.

Comparative Example

Figure 9:
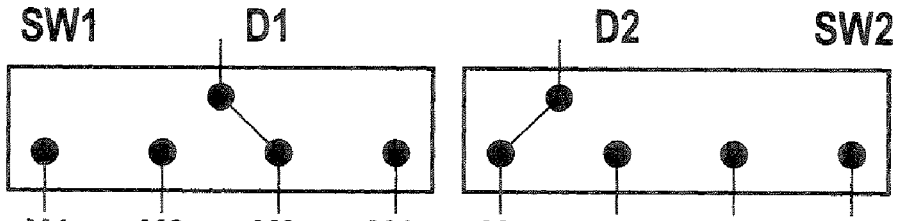
FIG. 9 is a view showing the voltage polarity and selection order of signal lines for each pixel in an n-th and n+1th frames.
Figure 9:
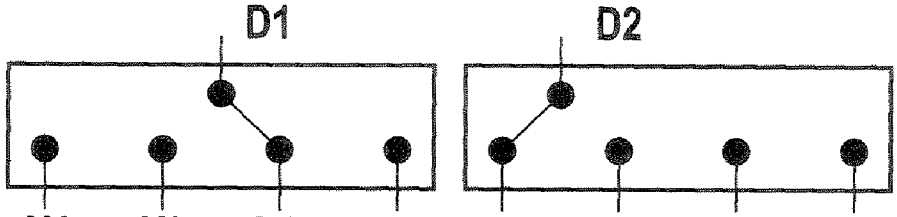

Next, in order to facilitate a better understanding of this embodiment, technique to make less visible the unevenness caused by write deficiency due to the inversion of voltage polarity of signal lines will be described as a comparative example in detail using the accompanying drawings. FIG. 9 shows the voltage polarity and selection order of signal lines for each pixel. Plus or minus symbol indicates the polarity of a video signal provided to a pixel via the first group X1 to X4 and second group X5 to X8 of signal lines. The number following the plus or minus symbol indicates the order of signal lines selected by the analog switch circuits SW1 and SW2 in one horizontal scanning period. For each frame, the voltage polarity of a signal line corresponding to each pixel is switched across the entire display screen.

In the multi-selection drive, a time to provide a video signal to one signal line within one horizontal scanning period becomes shorter as the number of selections of signal lines via the analog switch increases. In the four-selection drive as shown in this view, a video signal is to be written to a pixel via a signal line in a time equal to or less than ¼ of one horizontal scanning period.

The write conditions of a pixel in the multi-selection drive include two conditions, i.e., the polarity inversion of signal lines at the (L−1)th and L-th scanning lines, and the polarity inversion at the (S−1)th choice signal line and at the S-th choice signal line (hereinafter, referred to as the polarity inversion of an output of the driver IC). The condition becomes more severe in the polarity inversion of a signal line than in the polarity inversion of an output of the driver IC.

The write conditions of pixels shown in FIG. 9 are shown in FIG. 10 to FIG. 13.

FIG. 10 shows a distribution of pixels, in which the polarity inversion of a signal line occurs, in the voltage polarity and selection order of signal lines. The pixel with "−2" in which the polarity inversion of a signal line occurs has a relatively severe condition. The pixel with "0" is a pixel with no polarity inversion and has the best condition.

FIG. 11 shows a distribution of pixels, in which the polarity inversion of an output of the driver IC occurs, in the voltage polarity and selection order of signal lines. The pixel with "−1" in which the polarity inversion of an output of the driver IC occurs does not have a severe condition as compared with the pixel with "−2" of FIG. 10. The pixel with "0" has the best condition because there is no polarity inversion.

FIG. 12 shows the polarity inversion of signal lines of FIG. 10 in combination with the polarity inversion of an output of the driver IC of FIG. 11. The pixel with "−3" has the most severe condition because both signal line and output of the driver IC invert the polarity. The pixel with "0" has the best condition because there is no polarity inversion.

FIG. 13 shows a result obtained by averaging the combined results of the polarity inversion of a signal line and the polarity inversion of an output of the driver IC shown in FIG. 12 with the n-th and n+1th frames. The pixels with "−2.5" having a relatively severe write condition and the pixels with "−0.5" having a relatively good write condition are distributed in checkered pattern. In this way, by driving a signal line for all the scanning lines by the control circuit 22 while providing a periodicity of every M scanning lines to the voltage polarity of a signal line in each frame, the selection order of each group of signal lines is controlled depending on the voltage polarity of a signal line. Accordingly, the unevenness caused by write deficiency due to polarity inversion can be made less visible.

Figure 14:
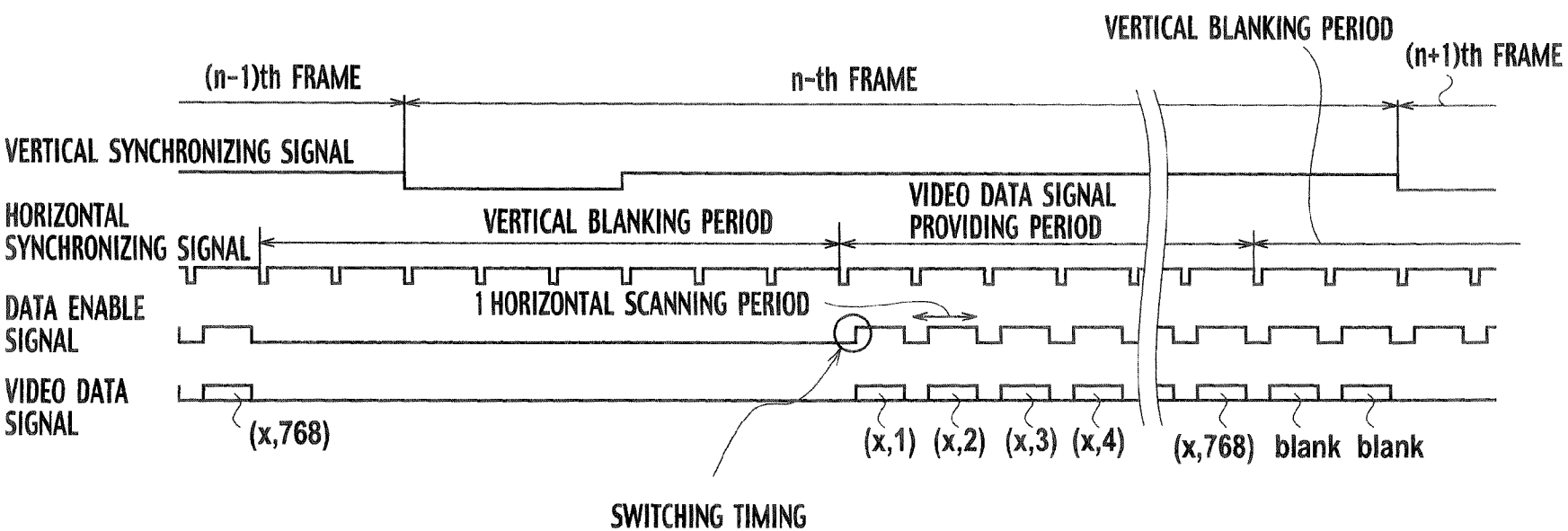
FIG. 14 is a timing chart showing synchronizing signals and a video data signal provided to the control circuit.

Next, the problem which the comparative example has is described using the accompanying drawings. A timing chart of FIG. 14 shows the synchronizing signals and video data signal that are provided from an external device to the control circuit 22 via an interface cable. The vertical synchronizing signal is a synchronizing signal indicative of the delimiter of a frame. The horizontal synchronizing signal is a synchronizing signal indicative of the timing of one scanning. The data enable signal is a synchronizing signal indicating that the video data signal for each scanning line is currently provided. Video data signals (x, 1) to (x, 768) are provided corresponding to each scanning line. Here, although there are a total of 768 scanning lines, two scanning lines of additional video data signals (blank) are provided.

Figure 15:
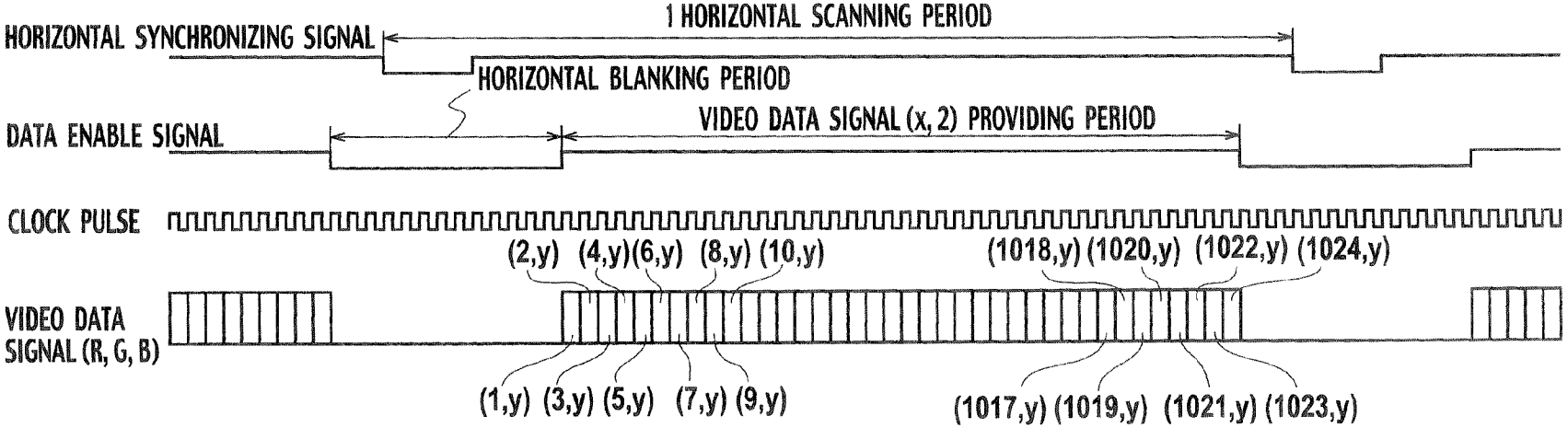
FIG. 15 is a timing chart showing the detail of the video data signal provided to the control circuit.

A timing chart of FIG. 15 shows the detailed configuration of (X, 2) of the video data signal shown in FIG. 14. The video data signal (x, 2) corresponding to the second scanning line is provided corresponding to the signal lines of 1024×3 (RGB) as video data signals (1, y) to (1024, y), in one horizontal scanning period after the end of a horizontal blanking period.

Conventionally, such switching of the voltage polarity of signal lines in each frame was carried out at the timing when the data enable signal was identified for the first time during the vertical blanking period at the beginning of a frame, as shown in FIG. 14.

However, in the conventional control circuit, even after providing video data signals corresponding to all the scanning lines and entering the vertical blanking period of the next frame, the periodicity of every four scanning lines is continuously provided to the voltage polarity of signal lines. For this reason, if the voltage polarity of signal lines is switched at the beginning of a frame, the periodicity of voltage polarity of signal lines may be disrupted. Hereinafter, the description is made in detail.

FIG. 16 is a view showing a case where the cycle of voltage polarity of signal lines is assigned from the first scanning line. Y(n) in the voltage polarity and selection order of the first group X1 to X4 of signal lines shown in FIG. 9 is assigned to the first scanning line Y(1), Y(n+1) is assigned to the second scanning line Y(2), Y(n+2) is assigned to the third scanning line Y(3), and Y(n+3) is assigned to the fourth scanning line Y(4).

FIG. 16(*a*) to FIG. 16(*d*) each show a case where the voltage polarity of signal lines from an n−1th frame to an n-th frame is switched at the beginning of a frame. Even after providing video data signals corresponding to all the scanning lines and entering the vertical blanking period of the next frame, the driving of signal lines is continuously carried out. For this reason, the voltage polarity and selection order Y(v) of a signal line, which is driven at the last in the n−1th frame prior to driving Y(1) at the beginning in the n-th frame, will differ in the respective cases (a) to (d).

In the case of FIG. 16(*d*), the final Y(v) in the n−1th frame is always a voltage polarity corresponding to the final line Y(4) in the cycle Y(1) to Y(4) of the voltage polarity of signal lines, and thus the periodicity of voltage polarity of signal lines is maintained between frames.

On the other hand, in the case of FIG. 16(*a*), the final Y(v) in the n−1th frame is a voltage polarity corresponding to the first line Y(1) in the cycle Y(1) to Y(4) of voltage polarity of signal lines. In the case of FIG. 16(*b*), the final Y(v) in the n−1th frame is a voltage polarity corresponding to the second line Y(2) in the cycle Y(1) to Y(4) of voltage polarity of signal lines. In the case of FIG. 16(*c*), the final Y(v) in the n−1th frame is a voltage polarity corresponding to the third line Y(3) in the cycle Y(1) to Y(4) of voltage polarity of signal lines. In this way, because in FIG. 16(*a*) to FIG. 16(*c*) the periodicity of voltage polarity of signal lines is disrupted between frames, a display problem will occur in the first scanning line when write deficiency occurred.

Hereinafter, a display problem occurred in the first scanning line is described taking the case of FIG. 16(*c*).

Figure 17:
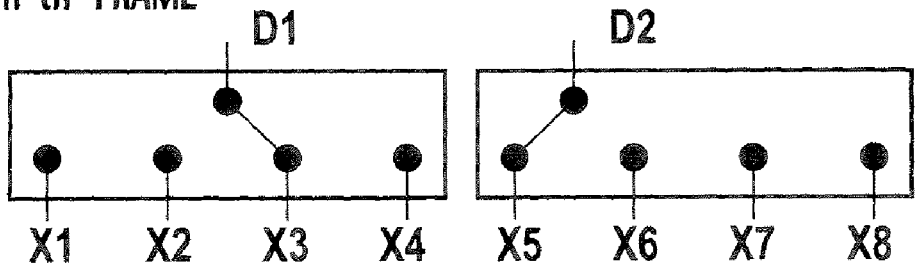
FIG. 17 is a view showing the voltage polarity and selection order of signal lines for each pixel in the n-th and n+1th frames in the case of FIG. 16.
Figure 17:
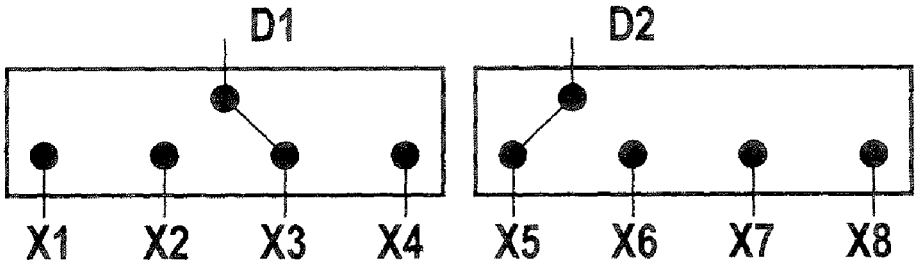

FIG. 17 shows the voltage polarity and selection order of signal lines for each pixel in the n-th and n+1th frames in the case of FIG. 16(*c*). Here, the first group X1 to X4 and second group X5 to X8 of signal lines are shown.

The write conditions occurring in pixels of this view are shown in FIG. 18 to FIG. 21.

FIG. 18 shows a distribution of pixels, in which the polarity inversion of a signal line occurs, in the voltage polarity and selection order of signal lines shown in FIG. 17. The pixel with "−2" in which the polarity inversion of a signal line occurs has a relatively severe condition. The pixel with "0" has the best condition because there is no polarity inversion.

FIG. 19 shows a distribution of pixels, in which the polarity inversion of an output of the driver IC occurs, in the selection order of signal lines and the polarity of video signals shown in FIG. 17. The pixel with "−1" in which the polarity inversion of an output of the driver IC occurs has less severe condition as compared with the pixel with "−2" of FIG. 18. The pixel with "0" has the best condition because there is no polarity inversion.

FIG. 20 shows the polarity inversion of signal lines of FIG. 18 in combination with the polarity inversion of an output of the driver IC of FIG. 19. The pixel with "−3" shown by diagonal lines has the most severe condition.

FIG. 21 shows a result obtained by averaging the combined results of the polarity inversion of signal lines and the polarity inversion of an output of the driver IC shown in FIG. 20 with the n-th and n+1th frames. The pixel with "−2.5" corresponding to the first scanning line Y(1) has a relatively severe write condition. As a result, because in the first scanning line a write deficiency is more likely to occur than in the other lines, the first scanning line appears bright (faded). In particular, when a half tone is displayed in the entire screen in a liquid crystal device, a difference in brightness between the first line and the second or subsequent line is prominent.

If the voltage polarity of signal lines is switched at the beginning of a frame under such condition that the write deficiency is likely to occur, the periodicity of voltage polarity of signal lines will be disrupted, so that the first scanning line is viewed as a display failure.

Then, as described above, in this embodiment, a control circuit controls so as to provide a voltage polarity of the final line out of the M lines to a signal line prior to driving the signal line corresponding to the first scanning line at the beginning of a frame. As shown in FIG. 5, prior to driving the signal line corresponding to the first scanning line Y(1) at the beginning of the n-th frame, a preliminary drive is performed so as to provide a voltage polarity of the final line Y(4) out of the four scanning lines Y(1) to Y(4) to the signal line. Accordingly, in the first scanning Y(1) the voltage polarity at the leading line of the four lines is provided to the signal line, so the periodicity of every four lines is maintained even when the cycle of voltage polarity is switched at the beginning of a frame. As a result, the drive conditions of pixels can be distributed evenly across the display screen, as shown in FIG. 13.

Accordingly, an unevenness caused by write deficiency due to the polarity inversion of a signal line in a flat display device is made less visible, thus allowing an excellent and stable display to be obtained.

Industrial Applicability

According to the flat display device and method of driving the same of the present invention, it is possible to obtain an excellent and stable display even when the cycle of voltage polarity is switched at the beginning of a frame at the time of driving a signal line while providing a periodicity of every M scanning lines to the voltage polarity of signal lines in each frame.

The invention claimed is:

1. A flat display device, characterized by comprising:

a pixel display part in which a pixel is disposed at each intersection between multiple rows of scanning lines and multiple columns of signal lines;

a driver circuit which provides a video signal through a video signal line;

an analog switch circuit that connects a signal line selected from N signal lines (N is an integer equal to or greater than 2) to the video signal line for each of groups in which each of the video signal lines from the driver circuit corresponds to N signal lines; and a control circuit which controls to drive the scanning lines and controls the driver circuit and the analog switch circuit, wherein the control circuit further controls to drive a signal line while providing a periodicity of every M scanning lines (M is an even number) of a voltage polarity of signal lines in each frame, and performs a preliminary drive of signal lines prior to providing a video signal to the signal line selected by the analog switch circuit corresponding to the first scanning line at the beginning of a frame, and the preliminary drive provides a polarity signal from the driver circuit to the video signal line and connects the signal line selected by the analog switch circuit to the video signal line sequentially to provide a voltage polarity of a final scanning line with the periodicity of every M lines in a condition that a drive of the scanning lines is stopped, and the voltage polarity of the polarity signal of the preliminary drive is set the same as the voltage polarity of the polarity signal of the final scanning line with the periodicity of every M lines.

2. The flat display device according to claim 1, wherein the control circuit comprises:

a data pre-processing part that converts a video data signal being provided into a driver data signal;

a line memory that stores the driver data signal output from the data pre-processing part;

a data post-processing part that divides the driver data signal, which is delayed by one horizontal cycle, output from the line memory for each signal line that the analog switch circuit selects; and a control part that controls the line memory and the data post-processing part; and the control circuit controls the preliminary drive during a write of the driver data signal of the signal line corresponding to the first scanning line in the line memory.

3. A method of driving a flat display device of a multi-selection drive method, the flat display device including a pixel display part in which a pixel is disposed at each intersection between multiple rows of scanning lines and multiple columns of signal lines, the flat display device being adapted to provide a video signal to a plurality of video signal lines and to selectively switch and connect the signal line by an analog switch, N signal lines (N is an integer equal to or greater than 2) corresponding to the each of video signal lines, the method comprising:

driving a signal while providing a periodicity of every M scanning lines (M is an even number) of a voltage polarity of the signal lines in each frame;

performing a preliminary drive of signal lines prior to providing a video signal to the signal lines selected by the analog switch circuit corresponding to the first scanning line at the beginning of a frame, the preliminary drive providing a polarity signal from the driver circuit to the video signal line and connecting the signal line selected by the analog switch circuit to the video signal line sequentially to provide a voltage polarity of a final scanning line with the periodicity of every M lines in a condition that a drive of the scanning lines is stopped; and the voltage polarity of the polarity signal of the preliminary drive is set the same as the voltage polarity of the polarity signal of the final scanning line with the periodicity of every M lines.

4. The method of driving a flat display device according to claim 3, further comprising:

converting a video data signal being provided into a driver data signal;

storing the driver data signal in a line memory; and dividing the driver data signal, which is delayed by one horizontal cycle, output from the line memory for each signal line that the analog switch circuit selects and at the same time performing the preliminary drive during a write of the driver data signal of the signal line corresponding to the first scanning line in the line memory.

* * * * *